US007218193B2

(12) United States Patent
Greywall

(10) Patent No.: US 7,218,193 B2
(45) Date of Patent: May 15, 2007

(54) MEMS-BASED INERTIAL SWITCH

(75) Inventor: Dennis S. Greywall, Whitehouse Station, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 10/919,134

(22) Filed: Aug. 16, 2004

(65) Prior Publication Data

US 2006/0033598 A1 Feb. 16, 2006

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 4,012,613 | A | 3/1977 | Watson | 200/61.08 |
| 4,178,492 | A | 12/1979 | Roesch et al. | 200/61.45 R |
| 5,177,579 | A * | 1/1993 | Jerman | 73/724 |
| 5,367,429 | A * | 11/1994 | Tsuchitani et al. | 361/280 |
| 5,501,893 | A | 3/1996 | Laermer et al. | 428/161 |
| 5,528,937 | A * | 6/1996 | Dufour | 73/514.32 |
| 5,629,790 | A * | 5/1997 | Neukermans et al. | 359/198 |
| 5,864,064 | A * | 1/1999 | Kano et al. | 73/514.36 |
| 5,955,712 | A | 9/1999 | Zakutin | 200/61.48 |
| 6,167,809 | B1 | 1/2001 | Robinson et al. | 102/235 |
| 6,201,631 | B1 | 3/2001 | Greywall | 359/245 |
| 6,354,712 | B1 | 3/2002 | Anteby | 362/103 |
| 6,481,285 | B1 * | 11/2002 | Shkel et al. | 73/504.13 |
| 6,520,017 | B1 * | 2/2003 | Schoefthaler et al. | 73/514.02 |
| 6,844,951 | B2 * | 1/2005 | Cannon et al. | 359/223 |
| 6,949,996 | B2 * | 9/2005 | Matsumoto et al. | 335/78 |
| 2005/0274184 | A1 * | 12/2005 | Zerbini et al. | 73/514.01 |

* cited by examiner

*Primary Examiner*—Elvin Enad
*Assistant Examiner*—Bernard Rojas

(57) ABSTRACT

In one embodiment, an inertial switch of the invention includes a MEMS device manufactured using a layered wafer. The MEMS device has a movable electrode supported on a substrate layer of the wafer and a stationary electrode attached to that substrate layer. The movable electrode is adapted to move with respect to the substrate layer in response to an inertial force such that, when the inertial force per unit mass reaches or exceeds a contact threshold value, the movable electrode is brought into contact with the stationary electrode, thereby changing the state of the inertial switch from open to closed. In one embodiment, the MEMS device is a substantially planar device, designed such that, when the inertial force is parallel to the device plane, the displacement amplitude of the movable electrode from an initial position is substantially the same for all force directions. Advantageously, inertial switches of the invention can be designed to have a relatively small size, e.g., less than one millimeter, and be relatively inexpensive. Due to the small size and low cost, several inertial switches of the invention may be incorporated into a corresponding switch circuit, thereby providing protection against mechanical failure and/or malfunction of any individual inertial switch in that circuit.

15 Claims, 2 Drawing Sheets

100
122
124
140
128a
128b
128c
130
132
134a
134b 110
112
114
116
122
140
128
126
124
140
100

200
226
228a
224
222
228b
228c
234a
234b 210
212
214
216
226
228
224
240
222
240
228
200

MEMS-BASED INERTIAL SWITCH

BACKGROUND OF THE INVENTION

1. Field of the Invention

The present invention relates to switches and, more specifically, to motion-sensitive switches. The present invention also relates to micro-electromechanical systems (MEMS).

2. Description of the Related Art

An inertial switch is a switch that can change its state, e.g., from open to closed, in response to acceleration and/or deceleration. For example, when the absolute value of acceleration along a particular direction exceeds a certain threshold value, the inertial switch changes its state, which change can then be used to trigger an electrical circuit controlled by the inertial switch. Inertial switches are employed in a wide variety of applications such as automobile airbag deployment systems, vibration alarm systems, detonators for artillery projectiles, and motion-activated light-flashing footwear. Description of several representative prior-art inertial switches can be found, for example, in U.S. Pat. Nos. 6,354,712, 5,955,712, 4,178,492, and 4,012,613, the teachings of all of which are incorporated herein by reference.

A conventional inertial switch is a relatively complex, mechanical device assembled using several separately manufactured components such as screws, pins, balls, springs, and other elements machined with relatively tight tolerance. As such, conventional inertial switches are relatively large (e.g., several centimeters) in size and relatively expensive to manufacture and assemble. In addition, conventional inertial switches are often prone to mechanical failure.

SUMMARY OF THE INVENTION

Problems in the prior art are addressed, in accordance with the principles of the present invention, by an inertial switch designed as a MEMS device. In one embodiment, the MEMS device is manufactured using a layered wafer and has a movable electrode supported on a substrate layer of the wafer and a stationary electrode attached to that substrate layer. The movable electrode is adapted to move with respect to the substrate layer in response to an inertial force such that, when the inertial force per unit mass reaches or exceeds a contact threshold value, the movable electrode is brought into contact with the stationary electrode, thereby changing the state of the inertial switch from open to closed. In one implementation, the MEMS device is a substantially planar device, designed such that, when the inertial force is parallel to the device plane, the displacement amplitude of the movable electrode from a zero-force position is substantially the same for all force directions. Advantageously, an inertial switch of the invention is a monolithic device, which enables the switch to have a relatively small size (e.g., about one millimeter) and be relatively inexpensive. Due to the small size and low cost, several inertial switches of the invention may be incorporated into a corresponding switch circuit, thereby providing protection against mechanical failure and/or malfunction of any individual inertial switch in that circuit.

DETAILED DESCRIPTION

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

Figures 1A, 1B, 2A, 2B:
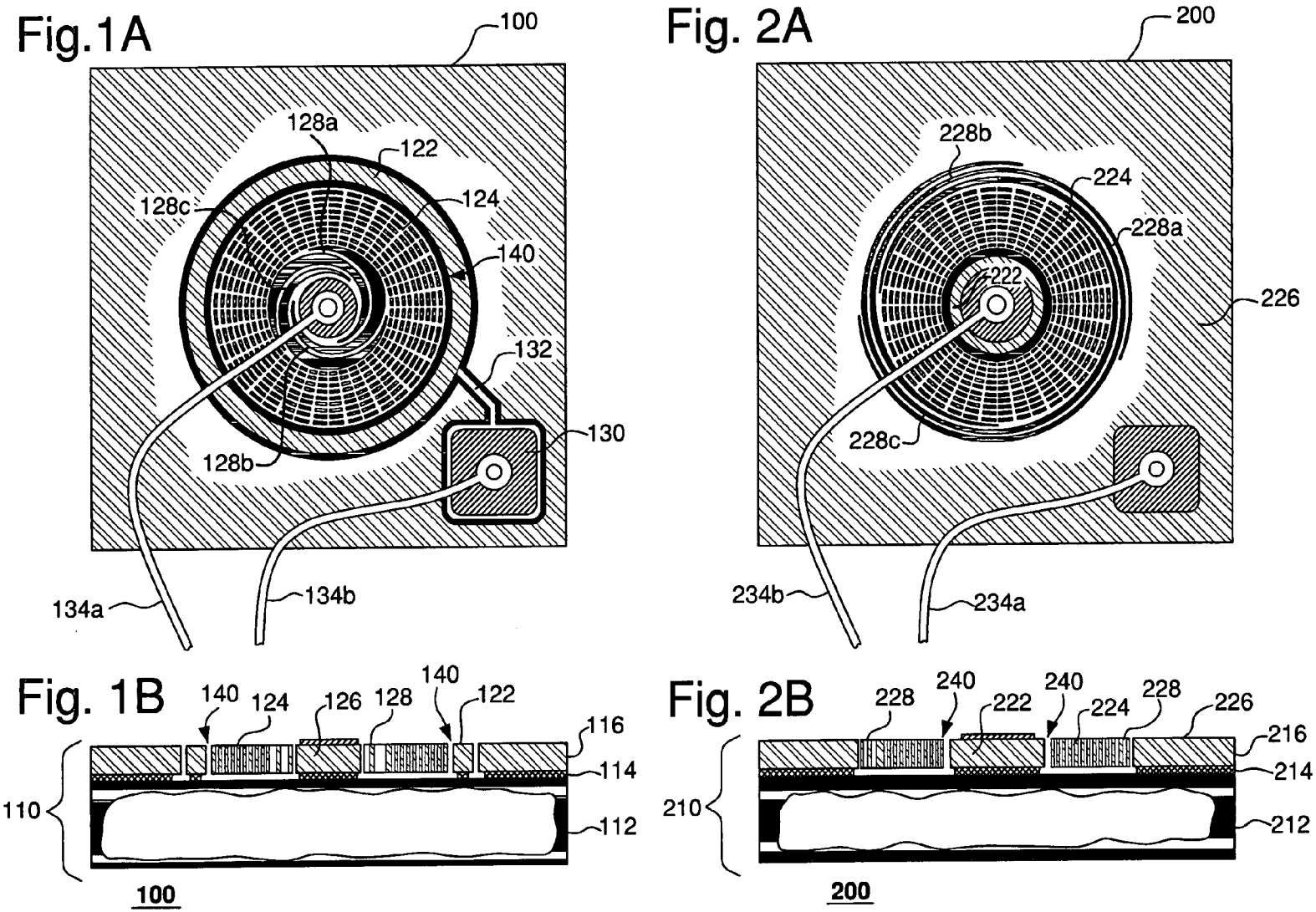
FIGS. 1A–B show top and cross-sectional views, respectively, of an inertial switch according to one embodiment of the present invention.
FIG. 2A–B show top and cross-sectional views, respectively, of an inertial switch according to another embodiment of the present invention.

FIGS. 1A–B show top and cross-sectional views, respectively, of an inertial switch 100 according to one embodiment of the present invention. Switch 100 is a MEMS device manufactured using a silicon-on-insulator (SOI) wafer 110. Since manufacturing techniques for fabricating SOI MEMS structures are well developed, switch 100 can be designed to have a relatively small size. For example, modem lithographic techniques may be used to define various switch elements in wafer 110 with a sub-micron resolution, thereby making it possible to have a switch 100 that takes up less than one square millimeter of the wafer area. As a result, a relatively large number of switches 100 can be manufactured using a single wafer 110, thereby significantly reducing the cost of each individual switch. Furthermore due to the small size and low cost, several instances of switch 100 may be incorporated into a corresponding switch circuit, thereby providing protection against mechanical failure and/or malfunction of any individual switch 100 in that circuit.

Wafer 110 has (i) two silicon layers, i.e., a substrate layer 112 and an overlayer 116, and (ii) a silicon oxide layer 114 located between overlayer 116 and substrate layer 112. Substrate layer 112 provides support for the switch structure; silicon oxide layer 114 provides electrical insulation between overlayer 116 and substrate layer 112; and overlayer 116 is used to define certain switch elements, each of which is described in more detail below. In particular, the following switch elements are defined in overlayer 116: a stationary electrode 122, a movable electrode 124, a support structure 126, a spring 128, a contact pad 130, and a conducting track 132.

Movable electrode 124 includes an annular mass detached from substrate layer 112 and supported on the substrate layer by spring 128 and support structure 126. Support structure 126 is located within an inner opening of the annular mass. In one embodiment, spring 128 has three planar spiral segments 128*a–c*, each attached between the outer circumference of support structure 126 and the inner circumference of the annular mass. The ends of spiral segments 128*a–c* that are attached to support structure 126 lie approximately on a circle and are separated from each other by an angle of about 120 degrees. Similarly, the ends of spiral segments 128*a–c* that are attached to the inner circumference of the annular mass of movable electrode 124 lie approximately on another circle and are also separated from each other by an angle of about 120 degrees. The circles are substantially concentric with each other and, for each of segments 128*a–c*, an angle between (i) a line passing through the circles center and the segment end attached to movable electrode 124 and (ii) a line passing through the circles center and the segment end attached to support structure 126 is about 240 degrees. As such, each of spiral segments 128*a–c* extends around support structure 126 for an angle of about 240 degrees. This configuration of spiral segments 128*a–c* produces an angular overlap between each pair of spiral segments of about 120 degrees. The presence of this overlap causes spring 128 to have a spring constant that is substantially isotropic within the plane defined by overlayer 116, i.e., substantially independent of the direction of the spring deformation within that plane. Consequently, a force of any particular magnitude acting within the plane of overlayer 116 produces a displacement for movable electrode 124, the amplitude of which displacement is substantially the same for all force directions.

In one embodiment, the annular mass of movable electrode 124 is an axially symmetric grid structure composed of radial and circular beams as indicated in FIG. 1A. One purpose of having this grid structure is to facilitate the detachment of movable electrode 124 from the underlying portion of substrate layer 112 during the fabrication process of switch 100. More specifically, a wet etchant that is typically used to remove selected portions of silicon oxide layer 114 during the fabrication process can be brought into good and sufficient contact with the portion of the silicon oxide layer initially present underneath electrode 124 by infiltrating the openings of the grid structure (see also FIG. 1B). Once in contact with that portion of silicon oxide layer 114, the wet etchant first removes the silicon oxide located directly under the grid openings and then undercuts the silicon oxide located under the beams of the grid structure, thereby detaching electrode 124 from substrate layer 112.

In one embodiment, stationary electrode 122 is a circular electrode that surrounds movable electrode 124. When movable electrode 124 is in its zero-force equilibrium position, the movable electrode is separated from stationary electrode 122 by a circular gap 140, the width of which defines a contact threshold value for switch 100. A contact threshold value for switch 100 is defined as the lowest possible value of an inertial force per unit mass that can bring movable electrode 124 into contact with stationary electrode 122. An increase in the designed width of gap 140 will result in an increase of the contact threshold value for switch 100 because, to make contact with stationary electrode 122, movable electrode 124 now has to cross a wider gap, which requires a greater displacement of the movable electrode from the initial equilibrium position and therefore an application of a greater inertial force to overcome the increased force generated by spring 128 due to the greater displacement.

Note that the thickness of overlayer 116 has substantially no effect on the contact threshold value because both the mass of movable electrode 124 and the spring constant of spring 128 change linearly with the thickness. In contrast, the spring constant of spring 128 for out-of-plane displacements of movable electrode 124 (i.e., displacements in the direction orthogonal to the plane of overlayer 116) is proportional to the cube of the thickness of overlayer 116. As a result, one can restrict out-of-plane displacements of movable electrode 124 by using in switch 100 an SOI wafer 110 having a relatively thick overlayer 116.

Movable electrode 124 is electrically connected to outside circuitry (not shown in FIG. 1) via spring 128, support structure 126, and a wire lead 134*a* attached to the top of the support structure. Similarly, stationary electrode 122 is electrically connected to the outside circuitry via conducting track 132, contact pad 130, and a wire lead 134*b* attached to the top of the contact pad.

Switch 100 may operate, for example, as follows. When switch 100 is at rest or moving at a constant velocity, gap 140 separates movable electrode 124 and stationary electrode 122, thereby keeping the switch in the open state. When switch 100 is accelerated such that the absolute value of the acceleration projection onto the plane of overlayer 116 exceeds the contact threshold value (discussed above), the resultant inertial force causes movable electrode 124 to cross gap 140 and come into contact with stationary electrode 122, thereby changing the state of switch 100 from open to closed. When the absolute value of the acceleration projection falls below the contact threshold value, the spring force of spring 128 causes movable electrode 124 to become separated from stationary electrode 122, thereby returning switch 100 into the open state.

One skilled in the art will understand that switch 100 reacts in a substantially analogous fashion to equal levels of acceleration and deceleration. This property of switch 100 can be understood from the following analysis. Suppose that switch 100 is triggered (i.e., changes its state from open to closed) by a certain amount of acceleration in a particular direction, denoted hereafter in this analysis as direction X. Then, due to the isotropic properties of spring 128 and substantial axial symmetry of electrodes 122 and 124, switch 100 will also be triggered by the same level of acceleration in the opposite direction, i.e., in direction −X. Then, by noting the fact that the inertial force generated by acceleration in direction −X is the same as the inertial force generated by equal deceleration in direction X, one arrives at the conclusion that, if switch 100 is triggered by acceleration in direction −X, it will also be triggered by equal deceleration in direction X. Comparing this conclusion with the initial supposition, one finally concludes that, if switch 100 is triggered by a certain level of acceleration in direction X, it will also be triggered by the equal level of deceleration in the same direction X. In view of this property of switch 100, said switch can be used in inertial sensors designed to detect an inertial force exceeding a selected threshold value regardless of the force origin or direction.

Different etching techniques may be used to fabricate switch 100 from the initial SOI wafer. It is known that silicon etches significantly faster than silicon oxide using, e.g., selective reactive ion etching (RIE). Similarly, silicon oxide etches significantly faster than silicon using, e.g., fluorine-based etchants. Various surfaces may be metal-plated using, e.g., chemical vapor deposition. Various parts of switch 100 may be mapped onto the overlayer of the SOI wafer using lithography. Additional description of various fabrication steps suitable for the fabrication of switch 100 may be found in U.S. Pat. Nos. 6,201,631, 5,629,790, and 5,501,893, the teachings of which are incorporated herein by reference.

FIGS. 2A–B show top and cross-sectional views, respectively, of an inertial switch 200 according to another embodiment of the present invention. Switch 200 is a MEMS device analogous to switch 100 of FIG. 1. Accordingly, analogous elements of switches 100 and 200 are marked in FIGS. 1 and 2 with labels having the same last two digits. Certain differences between switches 100 and 200 are outlined below.

Switch 200 has a movable electrode 224 that is substantially similar to movable electrode 124 of switch 100.

However, instead of stationary electrode 122 that surrounds movable electrode 124 in switch 100, switch 200 has a stationary electrode 222 located within an inner opening of the annular mass of movable electrode 224. Consequently, a gap 240 that separates the stationary and movable electrodes in switch 200 is located between the inner circumference of the annular mass of movable electrode 224 and the outer circumference of stationary electrode 222. In addition, unlike spring 128 in switch 100 that is placed at the inner circumference of the annular mass of movable electrode 124, a spring 228 in switch 200 is placed at the outer circumference of the annular mass of movable electrode 224.

In one embodiment, spring 228 has three planar spiral segments 228*a–c* similar in design to spiral segments 128*a–c* of spring 128 (FIG. 1). However, each of segments 228*a–c* is attached between the outer circumference of the annular structure of movable electrode 224 and a portion 226 of overlayer 216 located around the movable electrode. As such, portion 226 in switch 200 serves a function analogous to that of support structure 126 in switch 100. Similar to spring 128 in switch 100, spring 228 in switch 200 is designed to have a spring constant that is substantially isotropic within the plane defined by overlayer 216.

Movable electrode 224 is electrically connected to outside circuitry (not shown in FIG. 2) via spring 228, portion 226, and a wire lead 234*a* attached to portion 226. Similarly, stationary electrode 222 is electrically connected to the outside circuitry via a wire lead 234*b* attached to the top of the stationary electrode.

When switch 200 is at rest or moving with a constant velocity, gap 240 separates movable electrode 224 and stationary electrode 222, thereby keeping the switch in the open state. When switch 200 is accelerated/decelerated such that the absolute value of the acceleration/deceleration projection onto the plane of overlayer 216 exceeds the contact threshold value of the switch, the resultant inertial force causes movable electrode 224 to cross gap 240 and come into contact with stationary electrode 222, thereby changing the state of switch 200 from open to closed. When the absolute value of the acceleration/deceleration projection falls below the contact threshold value, the spring force of spring 228 causes movable electrode 224 to become separated from stationary electrode 222, thereby returning switch 200 into the open state.

Figure 3:
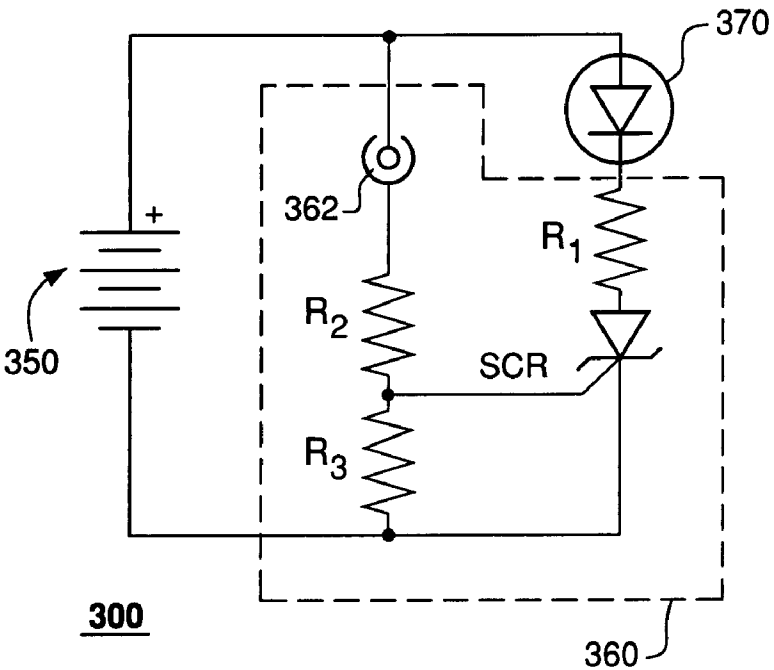
FIG. 3 shows a beacon circuit that can employ one of the inertial switches shown in FIGS. 1 and 2 according to one embodiment of the present invention.

FIG. 3 shows a beacon circuit 300 according to one embodiment of the present invention. Circuit 300 has a power source (e.g., a battery) 350, a crowbar circuit 360, and a beacon (e.g., a light-emitting diode) 370. Crowbar circuit 360 incorporates an inertial switch 362 that may be analogous to either one of switches 100 and 200 of FIGS. 1 and 2. Beacon circuit 300 turns on beacon 370 when inertial switch 362 is triggered (i.e., momentarily changes its state from open to closed). Beacon circuit 300 keeps beacon 370 in the on state even if, at a later time, inertial switch 362 returns to the open state. As a result, an observer can determine whether beacon circuit 300 is or has been subjected to a critical inertial force corresponding to the contact threshold value of inertial switch 362 by simply detecting a presence of the beacon signal.

Beacon circuit 300 operates, for example, as follows. In an initial state, inertial switch 362 is in the open state and a silicon-controlled rectifier (SCR) of crowbar circuit 360 is in the off state. This configuration holds beacon 370 in the off state. The SCR is a rectifier controlled by a gate signal. The SCR is switched from the off state (high resistance) to the on state (low resistance) by an appropriate signal applied to the gate. Once the SCR is turned on, it can remain in the on state even after removal of the gate signal as long as a minimum current, called the holding current, continues to flow through the SCR. In crowbar circuit 360, resistors R1, R2, and R3 are selected such that (i) the SCR is turned on when inertial switch 362 is triggered and (ii) a current greater than the holding current is maintained through the SCR, resistor R1, and beacon 370 when inertial switch 362 returns to the open state after the initial trigger.

Figure 4:
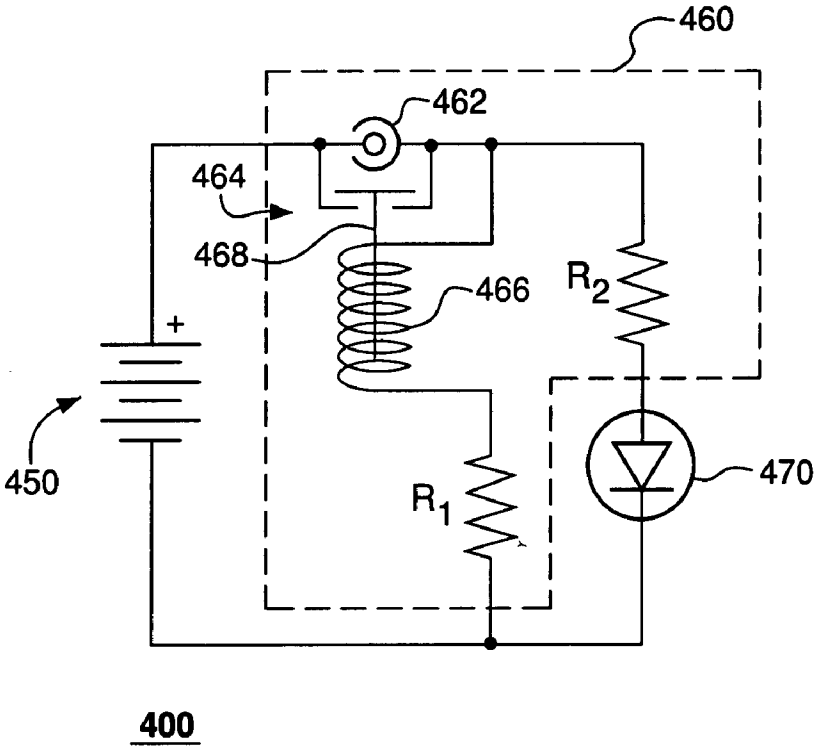
FIG. 4 shows a beacon circuit that can employ one of the inertial switches shown in FIGS. 1 and 2 according to another embodiment of the present invention.

FIG. 4 shows a beacon circuit 400 according to another embodiment of the present invention. Beacon circuit 400 comprises a power source (e.g., a battery) 450, a breaker circuit 460, and a beacon 470, and is analogous to beacon circuit 300 (FIG. 3). In particular, beacon circuit 400 (i) turns on beacon 470 when an inertial switch 462 incorporated into breaker circuit 460 is triggered and (ii) keeps beacon 470 in the on state even if, at a later time, inertial switch 462 returns into the open state.

Beacon circuit 400 operates, for example, as follows. In an initial state, both inertial switch 462 and a breaker switch 464 of breaker circuit 460 are in their open states, which holds beacon 470 in the off state. When inertial switch 462 is triggered, electrical current begins to flow through a coil 466 of breaker switch 464, which causes a T-shaped conductor 468 to be pulled toward the center of the coil, thereby connecting (closing) the contacts of breaker switch 464. Once breaker switch 462 is closed, electrical current continues to flow through coil 466 regardless of the state of inertial switch 462 because the breaker switch provides an electrical bypass around the inertial switch. As a result, T-shaped conductor 468 is kept in place by the electromagnetic force generated by coil 466, thereby keeping the contacts of breaker switch 464 closed. As such, breaker switch 464 provides power from power supply 450 to beacon 470 and keeps the beacon in the on state.

While this invention has been described with reference to illustrative embodiments, this description is not intended to be construed in a limiting sense. Various modifications of the described embodiments, as well as other embodiments of the invention, which are apparent to persons skilled in the art to which the invention pertains are deemed to lie within the principle and scope of the invention as expressed in the following claims.

Although inertial switches of the invention have been described in the context of silicon/silicon oxide SOI wafers, other suitable materials, such as germanium-compensated silicon, may similarly be utilized. The materials may be appropriately doped as known in the art. Various surfaces may be modified, e.g., by metal deposition for enhanced electrical conductivity or by ion implantation for enhanced mechanical strength. Differently shaped electrodes, segments, beams, grids, pads, tracks, and support structures may be implemented without departing from the scope and principle of the invention. Springs may have different shapes and sizes, where the term "spring" refers in general to any suitable elastic structure that can recover its original shape after being distorted. A different number of segments may be used to implement an isotropic spring without departing from the scope and principles of the invention. Various types of beacons may be used in beacon circuits of the invention, wherein a beacon may be any suitable means (not limited to electromagnetic radiation-emitting devices) for enabling an observer to determine whether a corresponding inertial switch of the beacon circuit has been triggered. Beacon circuits may or may not be designed to keep the beacon in the on state when, after an initial contact, the electrodes of the inertial switch become separated. Various switches of the invention may be arrayed or integrated on a chip with other circuitry as necessary and/or apparent to a person skilled in the art. Two or more variously oriented inertial switches of the invention may be incorporated into a beacon circuit to enable the circuit to sense variously oriented inertial forces.

For the purposes of this specification, a MEMS device is a device having two or more parts adapted to move relative to one another, where the motion is based on any suitable interaction or combination of interactions, such as mechanical, thermal, electrical, magnetic, optical, and/or chemical interactions. MEMS devices are fabricated using micro- or smaller fabrication techniques (including nano-fabrication techniques) that may include, but are not limited to: (1) self-assembly techniques employing, e.g., self-assembling monolayers, chemical coatings having high affinity to a desired chemical substance, and production and saturation of dangling chemical bonds and (2) wafer/material processing techniques employing, e.g., lithography, chemical vapor deposition, patterning and selective etching of materials, and treating, shaping, plating, and texturing of surfaces. The scale/size of certain elements in a MEMS device may be such as to permit manifestation of quantum effects. Examples of MEMS devices include, without limitation, NEMS (nano-electromechanical systems) devices, MOEMS (micro-opto-electromechanical systems) devices, micromachines, microsystems, and devices produced using microsystems technology or microsystems integration.

Although the present invention has been described in the context of implementation as MEMS devices, the present invention can in theory be implemented at any scale, including scales larger than micro-scale.

What is claimed is:

1. A MEMS device, comprising:

a movable electrode supported on a substrate; and a stationary electrode attached to the substrate, wherein:

the movable electrode is adapted to move with respect to the substrate in response to an inertial force acting upon the MEMS device such that, when the inertial force reaches or exceeds a contact threshold value, the movable electrode is brought into contact with the stationary electrode the movable electrode comprises an annular mass supported by a segmented spring attached between the annular mass and a support structure; and the annular mass comprises an open grid structure.

2. The invention of claim 1, wherein the substrate defines a plane, wherein, when the inertial force is parallel to said plane, displacement amplitude of the movable electrode from an initial position is substantially the same for all force directions.

3. The invention of claim 1, wherein the segmented spring is a substantially planar spring having a substantially isotropic spring constant for deformations within a plane defined by the spring.

4. The invention of claim 1, wherein:

the segmented spring comprises three spiral segments, each attached between the annular mass and the support structure;

segment ends that are attached to the support structure lie approximately on a first circle and are separated from each other by an angle of about 120 degrees; and segment ends that are attached to the annular mass lie approximately on a second circle and are separated from each other by an angle of about 120 degrees.

5. The invention of claim 1, wherein each segment spans for about 240 degrees about an axis of the annular mass.

6. The invention of claim 1, wherein:

the support structure is located within an opening of the annular mass; and the stationary electrode surrounds the annular mass.

7. The invention of claim 1, wherein the open grid structure has an axial symmetry and includes interconnecting circular and radial beams.

8. The invention of claim 1, wherein the MEMS device is fabricated using a layered wafer, wherein:

the substrate is a first layer of said wafer; and the movable and stationary electrodes are fabricated from a second layer of said wafer deposited over the first layer.

9. The invention of claim 1, wherein the MEMS device is adapted to react in a substantially similar fashion to equal levels of acceleration and deceleration.

10. A MEMS device, comprising:

a movable mass supported on a substrate;

a support structure attached to the substrate; and a segmented spring attached between the movable mass and the support structure, wherein the segmented spring is a substantially planar spring having a substantially isotropic spring constant for deformations within a plane defined by the spring, wherein:

the segmented spring comprises three spiral segments, each attached between the movable mass and the support structure;

segment ends that are attached to the support structure lie approximately on a first circle and are separated from each other by an angle of about 120 degrees; and segment ends that are attached to the movable mass lie approximately on a second circle and are separated from each other by an angle of about 120 degrees.

11. The invention of claim 10, wherein the first and second circles are substantially concentric with each other and, for each segment, an angle between (i) a line passing through the circles center and the segment end attached to the movable mass and (ii) a line passing through the circles center and the segment end attached to the support structure is about 240 degrees.

12. The invention of claim 10, wherein the MEMS device is fabricated using a layered wafer, wherein:

the substrate is a first layer of said wafer; and the segmented spring is fabricated from a second layer of said wafer deposited over the first layer.

13. A MEMS device, comprising:

a movable electrode supported on a substrate; and a stationary electrode attached to the substrate, wherein:

the movable electrode is adapted to move with respect to the substrate in response to an inertial force acting upon the MEMS device such that, when the inertial force reaches or exceeds a contact threshold value, the movable electrode is brought into contact with the stationary electrode;

the movable electrode comprises an annular mass supported by a segmented spring attached between the annular mass and a support structure;

the segmented spring comprises three spiral segments, each attached between the annular mass and the support structure;

segment ends that are attached to the support structure lie approximately on a first circle and are separated from each other by an angle of about 120 degrees; and segment ends that are attached to the annular mass lie approximately on a second circle and are separated from each other by an angle of about 120 degrees.

14. A MEMS device, comprising:

a movable electrode supported on a substrate; and a stationary electrode attached to the substrate, wherein:

the movable electrode is adapted to move with respect to the substrate in response to an inertial force acting upon the MEMS device such that, when the inertial force reaches or exceeds a contact threshold value, the movable electrode is brought into contact with the stationary electrode;

the movable electrode comprises an annular mass supported by a segmented spring attached between the annular mass and a support structure; and each segment spans for about 240 degrees about an axis of the annular mass.

15. A MEMS device, comprising:

a movable electrode supported on a substrate; and a stationary electrode attached to the substrate, wherein:

the movable electrode is adapted to move with respect to the substrate in response to an inertial force acting upon the MEMS device such that, when the inertial force reaches or exceeds a contact threshold value, the movable electrode is brought into contact with the stationary electrode;

the movable electrode comprises an annular mass supported by a segmented spring attached between the annular mass and a support structure;

the support structure is located within an opening of the annular mass; and the stationary electrode surrounds the annular mass.

* * * * *